US006924773B1

(12) United States Patent
Paratte

(10) Patent No.: US 6,924,773 B1
(45) Date of Patent: Aug. 2, 2005

(54) INTEGRATED DUAL BAND H-FIELD SHIELDED LOOP ANTENNA AND E-FIELD ANTENNA

(75) Inventor: Blaise Paratte, Colombier (CH)

(73) Assignee: Codman Neuro Sciences Sarl, LeLochle (CH)

( * ) Notice: Subject to any disclaimer, the term of this patent is extended or adjusted under 35 U.S.C. 154(b) by 0 days.

(21) Appl. No.: 10/955,677

(22) Filed: Sep. 30, 2004

(51) Int. Cl.[7] ..... H01Q 21/00
(52) U.S. Cl. ..... 343/728; 343/842
(58) Field of Search ..... 343/728, 842, 343/885, 741, 744, 748, 725, 729; H01Q 21/00

(56) References Cited

U.S. PATENT DOCUMENTS

| | | | | |
|---|---|---|---|---|
| 2,419,539 A | | 4/1947 | Clark et al. | |
| 3,882,506 A | | 5/1975 | Mori et al. | |
| 4,433,336 A | | 2/1984 | Carr | |
| 4,571,595 A | | 2/1986 | Phillips et al. | |
| 5,274,388 A | * | 12/1993 | Ishizaki et al. | 343/725 |
| 5,363,113 A | * | 11/1994 | Mametsa et al. | 343/744 |
| 5,583,521 A | | 12/1996 | Williams | |
| 5,600,341 A | | 2/1997 | Thill et al. | |
| 5,673,053 A | * | 9/1997 | Marthinsson | 343/728 |
| 6,236,374 B1 | | 5/2001 | Nordin | |
| 6,323,820 B1 | | 11/2001 | Haunberger | |
| 6,326,921 B1 | | 12/2001 | Egorov et al. | |
| 6,559,811 B1 | | 5/2003 | Pulimi et al. | |
| 6,734,826 B1 | | 5/2004 | Dai et al. | |
| 2003/0103014 A1 | | 6/2003 | Bimbaum et al. | |

* cited by examiner

*Primary Examiner*—Hoanganh Le
(74) *Attorney, Agent, or Firm*—Cheryl F. Cohen

(57) ABSTRACT

A dual band antenna system that combines into a single integrated device an H-field shielded loop antenna and an E-field antenna. The system includes an unshielded section bounded on each end by first and second shielded sections, respectively. Input frequency filters are electrically connected to the first shielded section to selectively pass one of a first radio frequency signal or a second radio frequency signal through the first shielded section. Output frequency filters electrically connected to the unshielded section for switching between two paths of transmission and associated modes of operation: (i) a first mode (operating as an H-field antenna) in which an H-field transmission pattern is generated in the first and second shielded sections; and (ii) a second mode (operating as an E-field antenna) wherein an E-field is radiated via the E-field antenna.

20 Claims, 3 Drawing Sheets

INTEGRATED DUAL BAND H-FIELD SHIELDED LOOP ANTENNA AND E-FIELD ANTENNA

BACKGROUND OF THE INVENTION

1. Field of the Invention

The present invention is directed to a dual band antenna and, in particular, to an H-field shielded loop antenna (for example, as used in radio frequency identification (RFID), passive telemetry and transcutaneous energy transfer) combined with an E-field antenna such as a wireless application antenna.

2. Description of Related Art

Electromagnetic interference (EMI) degrades optimum performance of electronic devices. Ideally, electronic devices should function in a state of electromagnetic compatibility (EMC) causing substantially no interference to and receiving substantially no interference from other electronic sources. In order to be compliant with EMC standards electronic devices are shielded to increase immunity to external perturbation and minimize unintentional radiation of the device.

Shielded loop antennas are currently used, for example, as an electromagnetic H-field inductor or receiving coil for radio frequency identification (RFID), passive telemetry and transcutaneous energy transfer, e.g., communication with implantable medical devices. The loop antenna comprises a shielded transmission line, e.g., coaxial line, stripline or microstrip line. However, often devices employ multiple antennas such as an H-field antenna and an E-field antenna used, for example, to communicate wirelessly with a remote control device. Shielding of an E-field wireless application antenna, i.e., an antenna that communicates with a wireless device such as an external control unit, personal computer, Personal Digital Assistant (PDA) or mobile/cellular phone, is impractical since substantially all radiation of signals necessary for wireless communication would be inhibited by the shield. Accordingly, heretofore when employing an H-field shielded loop antenna a second separate E-field wireless application antenna must be disposed outside or exteriorly of the shield. In this conventional configuration the use of two separate antenna devices undesirably increases the overall cost and size of the system.

It is therefore desirable to develop an integrated H-field shielded loop antenna and an E-field antenna while solving the aforementioned problems associated with conventional devices.

SUMMARY OF THE INVENTION

The present invention is directed to an integrated dual band antenna system that solves the aforementioned problems associated with conventional devices.

In particular, the present inventive dual band antenna system combines an H-field shielded loop antenna and an E-field antenna into a single integrated device thereby reducing its overall size and cost of manufacture.

In a first embodiment, the present invention is directed to an integrated dual band antenna system including an H-field antenna and an E-field antenna. The H-field antenna comprises: (i) a first shielded section having a first end and an opposite second end, the first end of the first shielded section being adapted to receive one of a first radio frequency signal or a second radio frequency signal different than the first radio frequency signal; (ii) a second shielded section having a first end and an opposite second end; and (iii) an unshielded section disposed between the second ends of the first and second shielded sections forming an unshielded gap. A first input frequency filter is electrically connected to the first end of the first shielded section, wherein the first input frequency filter passes therethrough the first radio frequency signal. Similarly, a second input frequency filter is electrically connected to the first end of the first shielded section and passes therethrough the second radio frequency signal. A first output frequency filter is disposed in the unshielded section and electrically connected between the first and second shielded section. A second output frequency filter is electrically connected between the unshielded section and the E-field antenna. The first input frequency filter and first output frequency filter are matched to one another so as to pass therethrough the first radio frequency signal. Likewise, the second input frequency filer and second output frequency filter are matched to one another so as to pass therethrough the second radio frequency signal. The integrated dual band antenna operates in a first mode wherein the first radio frequency signal passes through the first input frequency filter, the first shielded section, the first output frequency filter, the second shielded section, and generates an H-field transmission pattern through both shielded sections. In a second mode of operation, the second radio frequency signal passes through the second input frequency filter, the first shielded section, the second output frequency filter and radiates an E-field via the E-field antenna.

Another embodiment of the invention relates to a method for operating an integrated dual band antenna system as described above. Specifically, an input to the first shielded section is selected between a first radio frequency signal RF1 or a second radio frequency signal RF2. The selected radio frequency signal is then transmitted through the first shielded section. Finally, within the unshielded section, switching of transmission paths so as to operate in a first mode the E-field antenna or in a second mode the H-field shielded loop antenna.

BRIEF DESCRIPTION OF THE DRAWING

The foregoing and other features of the present invention will be more readily apparent from the following detailed description and drawings of illustrative embodiments of the invention wherein like reference numbers refer to similar elements throughout the several views and in which.

DETAILED DESCRIPTION OF THE INVENTION

The present invention integrates into a single device an H-field shielded loop antenna and an E-field antenna. This integrated dual band antenna 100 advantageously minimizes both cost and overall space by employing a single integrated antenna for multiple applications. By way of example, the present invention is shown and described as part of an antenna system 100 for communication with an implantable medical device 140 and a wireless interface device 130 such as a control unit, personal computer, Personal Digital Assistant (PDA) or mobile/cellular phone. The implantable medical device 140 includes, but is not limited to, an implantable infusion pump, implantable tissue stimulator, pacemaker, defibrillator, and implantable physiologic sensor. Electronic devices in areas other than the medical field may be employed in accordance with the present invention.

Figure 1:
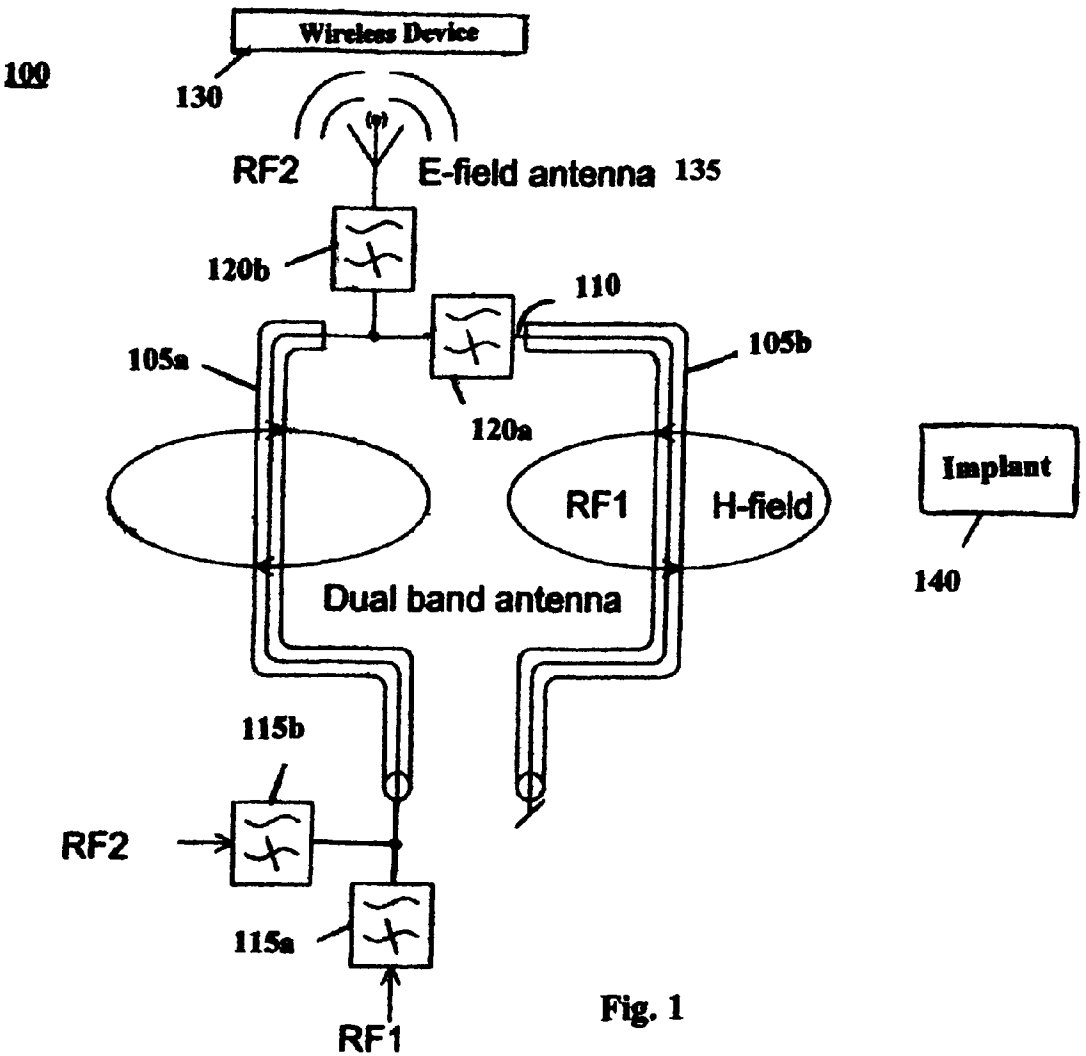
FIG. 1 is an exemplary schematic diagram of an integrated dual band H-field shielded loop antenna and E-field antenna in accordance with the present invention.

An exemplary schematic circuit diagram of an integrated dual band antenna 100 for use with an implantable medical device 140 and wireless device 130 in accordance with the present invention is shown in FIG. 1. The integrated dual band antenna 100 is preferably fabricated on a PCB and operates as both an E-field antenna and an H-field loop antenna. The H-field shielded loop antenna comprises first and second shielded sections or lines 105*a*, 105*b*, respectively, separated from one another by an unshielded section or gap 110. Each shielded section or line of the H-field loop antenna may be fabricated from a shielded coaxial line, strip line, microstrip line or other shielded conventional transmission line. Shielded section or line 105*a* has a first end and an opposite second end proximate the unshielded section 110. Similarly, shielded section or line 105*b* has a first end proximate the unshielded section 110 and an opposite second end. The first shielded section 105*a* receives as input at its first end one of at least two radio frequency signals, while the second end of the second shielded section 105*b* is grounded.

In the exemplary embodiment shown in FIG. 1, two input frequency filters 115*a*, 115*b* are connected to the first end of the first shielded section or line 105*a* for selecting or switching between one of two different radio frequency signals (RF1, RF2) to be guided or passed through the first shielded section or line 105*a*. By way of example, the second radio frequency signal RF2 is received as input to the second input frequency filter 115*b*, whereas the first radio frequency signal RF1 is received as input to the first input frequency filter 115*a*. In a preferred embodiment, the first input frequency filter 115*a* is a low pass filter (LPF) or a band pass filter (BPF) while the second frequency filter 115*b* is a high pass filter (HPF) or a band pass filter (BPF). The second radio frequency signal RF2 is preferably substantially greater than that of the first radio frequency signal RF1. For instance, the second radio frequency signal RF2 may be any wireless frequency, for example, in the range between approximately 1 GHz to approximately 3 GHZ, preferably, a Bluetooth signal at approximately 2.4 GHz. On the other hand, the first radio frequency signal RF1 is preferably significantly lower, for example, in the range between approximately 9 kHz to approximately 100 MHz. At the unshielded section 110 between the two shielded sections 105*a*, 105*b* is disposed a set of two output frequency filters 120*a*, 120*b* the same as input frequency filters 115*a*, 115*b*, respectively. Output frequency filter 120*a* is connected between the first and second shielded sections 105*a*, 105*b*. The other output frequency filter 120*b* is electrically connected between the unshielded section 110 and the E-field antenna 135.

Figure 2:
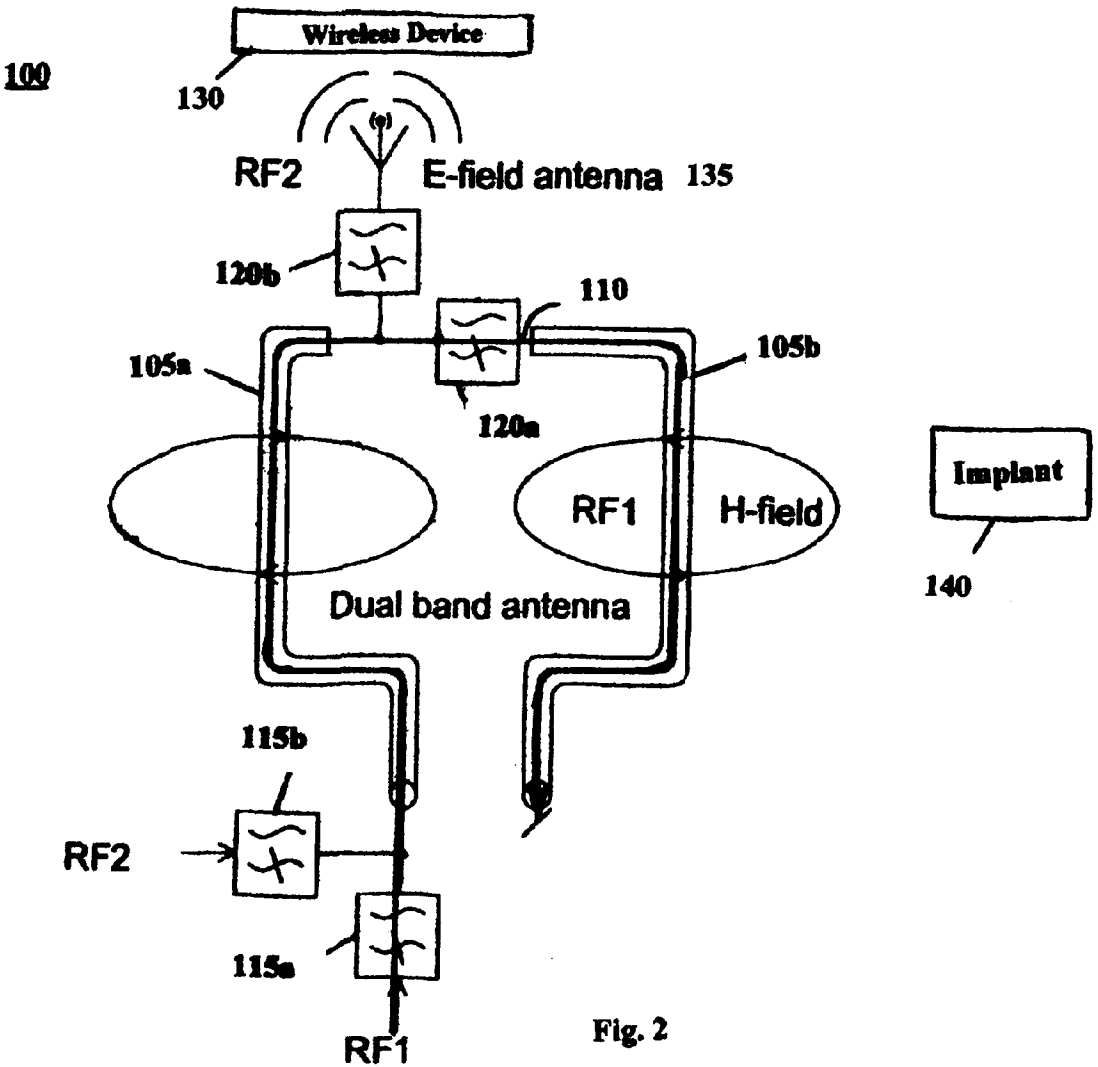
FIG. 2 is an exemplary schematic diagram of the integrated dual band antenna of FIG. 1 operating as an H-field antenna.
Figure 3:
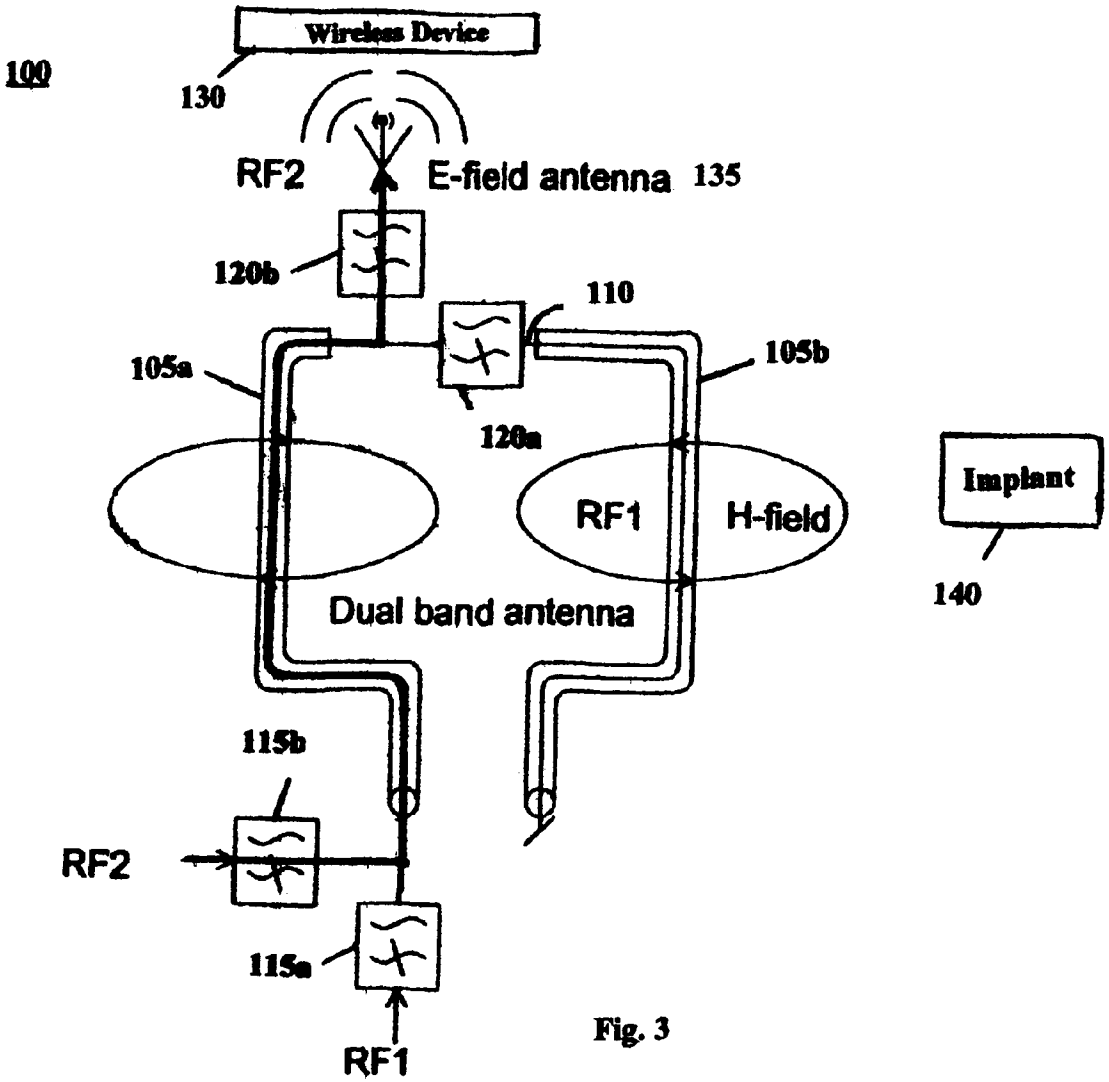
FIG. 3 is an exemplary schematic diagram of the integrated dual band antenna of FIG. 1 operating as an E-field antenna.

In operation, as represented in FIG. 2, the integrated dual band antenna operates in a first mode as an H-field antenna for use as an electromagnetic H-field inductor or receiving coil (e.g., used for radio frequency identification (RFID), passive telemetry communication and transcutaneous energy transfer (TET)) when the first radio frequency signal RF1 is guided through the first shielded section 105*a*, the unshielded section 110 and the second shielded section 105*b* to produce a transmission pattern for a magnetic field (H-field). While operating as an H-field antenna, the integrated dual band antenna receives as input to the first shielded loop section 105*a* the first radio frequency signal RF1, such as a low frequency signal (e.g., approximately 13.56 MHz or approximately 27.12 MHz). The first radio frequency signal RF1 passes through the low pass or band pass input filter 115*a* and is guided through the first shielded loop section 105*a*. Upon reaching the unshielded section 110, the transmitted first radio frequency signal RF1 passes unchanged through the low pass or band pass output filter 120*a* and is guided into the second shielded section 105*b*. While passing through the first and second shielded sections 105*a*, 105*b*, the first radio frequency signal RF1 produces a transmission pattern for a magnetic field (H-field) thereby serving as an electromagnetic H-field inductor or receiving coil for an electronic device. In the example shown in FIG. 2, shielded sections 105*a* and 105*b* serve as an inductor or receiving coil to communicate with the implantable medical device 140.

The loop antenna can alternatively operate in a second mode for communication with a wireless interface device 130 by connecting to the E-field antenna for radiating or receiving radio signals. In this case the input to the first shielded loop section 105*a* is the second radio frequency signal RF2. By way of example, the second radio frequency signal RF2 may be a high frequency signal, for example, in the range between approximately 1 GHz to approximately 3 GHZ, preferably a Bluetooth signal at approximately 2.4 GHz, that passes through the high pass or band pass input filter 115*b* and is guided through the first shielded loop section 105*a*. At the unshielded section 110, the high frequency output filter 120*b* transmits the second radio frequency signal RF2 to the E-field antenna 135. In the situation described herein, the frequency of the second radio frequency signal RF2 is substantially greater than that of the first radio frequency signal RF1. For example, the first radio frequency signal RF1 may be in the range between approximately 9 KHz to approximately 100 MHz, while the second radio frequency signal RF2 is any wireless signal, for example, in the range between approximately 1 GHz to approximately 3 GHZ, preferably a Bluetooth signal at approximately 2.4 GHz. The E-field antenna 135 such as an SMT ceramic antenna or a PCB printed antenna permits radiation of the electric field (E-field) for communication with a wireless interface device 130.

The frequencies of the radio signals may be chosen, as desired, along with the appropriate frequency filters. Frequency filters, 115*a*, 115*b*, 120*a*, 120*b*, preferably employ conventional passive lumped components and/or printed elements, both of which are well known in the art. In an exemplary embodiment, output frequency filter 120*a* is an inductor of relatively small value while output frequency filter 120*b* is a capacitor of relatively low capacitance. When the integrated dual band antenna 100 receives as input a low frequency signal RF1, the capacitor 120*b* behaves as an open circuit while the inductor 120*a* acts like a wire or closed circuit guiding the low frequency signal RF1 into the shielded sections 105*a* and 105*b*. The low frequency signal RF1 while passing through the second shielded section 105*b* produces a transmission pattern for a magnetic field (H-field) thereby serving as an electromagnetic H-field inductor or receiving coil for an electronic device. On the other hand, when the integrated dual band antenna receives as input a high frequency signal RF2. In this instance, the inductor 120*a* behaves as an open circuit while the capacitor 120*b* serves as a closed circuit connecting to the E-field antenna 135.

When designing the antenna system, the size of the gap or unshielded section 110 is preferably selected to balance on the one hand the minimum amount of space necessary to accommodate the dimensions of the output frequency filter while on the other hand maximizing the amount of shielding. For example, the size of the gap or unshielded section 110 may be approximately 6 mm.

Accordingly, the present invention dual band antenna integrates into a single compact device both an H-field shielded loop antenna and an E-field antenna. This integrated dual band antenna advantageously reduces the overall cost of manufacture and size of the system.

Thus, while there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps that perform substantially the same function, in substantially the same way, to achieve the same results be within the scope of the invention. Substitutions of elements from one described embodiment to another are also fully intended and contemplated. It is also to be understood that the drawings are not necessarily drawn to scale, but that they are merely conceptual in nature. It is the intention, therefore, to be limited only as indicated by the scope of the claims appended hereto.

Every issued patent, pending patent application, publication, journal article, book or any other reference cited herein is each incorporated by reference in their entirety.

What is claimed is:

1. An integrated dual band antenna system comprising:

an H-field antenna comprising: (i) a first shielded section having a first end and an opposite second end, the first end of the first shielded section being adapted to receive one of a first radio frequency signal or a second radio frequency signal different than the first radio frequency signal; (ii) a second shielded section having a first end and an opposite second end; and (iii) an unshielded section disposed between the second ends of the first and second shielded sections forming an unshielded gap;

a first input frequency filter electrically connected to the first end of the first shielded section, the first input frequency filter passing therethrough the first radio frequency signal;

a second input frequency filter electrically connected to the first end of the first shielded section, the second input frequency filter passing therethrough the second radio frequency signal;

a first output frequency filter electrically connected to the unshielded section, the first input frequency filter and first output frequency filter being matched to one another so as to pass therethrough the first radio frequency signal;

a second output frequency filter electrically connected to the unshielded section, the second input frequency filter and second output frequency filter being matched to one another so as to pass therethrough the second radio frequency signal; and an E-field antenna electrically connected to the second output frequency filter;

the integrated dual band antenna operates in a first mode wherein the first radio frequency signal passes through the first input frequency filter, the first shielded section, the first output frequency filter, the second shielded section and generates an H-field transmission pattern in both the first and the second shielded sections; the integrated dual band antenna operates in a second mode wherein the second radio frequency signal passes through the second input frequency filter, the first shielded section, the second output frequency filter and radiates an E-field via the E-field antenna.

2. The system in accordance with claim 1, wherein the second radio frequency signal is substantially greater than the first radio frequency signal.

3. The system in accordance with claim 2, wherein the second radio frequency signal is a wireless communication signal, while the first radio frequency signal is at least one of a telemetry, transcutaneous energy transfer or data signal.

4. The system in accordance with claim 3, wherein the second radio frequency signal is in the range of approximately 1 GHz to approximately 3 GHz, while the first radio frequency signal is in the range of approximately 9 kHz to approximately 100 MHz.

5. The system in accordance with claim 2, wherein the first input frequency filter and first output frequency filter are low pass or band pass filters, while the second input frequency filter and second output frequency filter are high pass or band pass filters.

6. The system in accordance with claim 1, further comprising a wireless interface device for receiving via wireless communication the radiated second radio frequency signal.

7. The system in accordance with claim 1, further comprising an implantable medical device for receiving via telemetry communication the first radio frequency signal.

8. The system in accordance with claim 1, wherein the filters comprise passive components.

9. The system in accordance with claim 8, wherein the first output frequency filter is an inductor and the second output frequency filter is a capacitor.

10. A method for operating an integrated dual band antenna having an H-field shielded loop antenna and an E-field antenna including (i) a first shielded section having a first end and an opposite second end, the first end of the first shield section being adapted to receive one of a first radio frequency signal and a second radio frequency signal different than the first radio frequency signal; (ii) a second shielded section having a first end and an opposite second end; and (iii) an unshielded section disposed between the second ends of the first and second shielded sections forming an unshielded gap, the method comprising the steps of:

selecting as input to the first shielded section one of the first radio frequency signal or the second radio frequency signal;

transmitting the selected one of the first radio frequency signal or the second radio frequency signal through the first shielded section; and within the unshielded section of the loop antenna, switching of transmission paths so as to operate in a first mode the H-field shielded loop antenna or in a second mode the E-field antenna.

11. The method in accordance with claim 10, wherein the selecting step comprises passing the first radio frequency signal through a first input frequency filter electrically connected to the first end of the first shielded section.

12. The method in accordance with claim 11, wherein the switching step comprises passing the first radio frequency signal through a first output frequency filter matching the first input frequency filter, the first output frequency filter being electrically connected to the unshielded section.

13. The method in accordance with claim 12, wherein the first input frequency filter and the first output frequency filter are low pass or band pass filters.

14. The method in accordance with claim 12, further comprising guiding the first radio frequency signal that has passed through the first output frequency filter into the second shielded section and generating an H-field transmission pattern in the first and second shielded sections.

15. The method in accordance with claim 10, wherein the selecting step comprises passing the second radio frequency signal through a second input frequency filter electrically connected to the first end of the first shielded section.

16. The method in accordance with claim 15, wherein the switching step comprises passing the second radio frequency signal through a second output frequency filter matching the second input frequency filter, the second output frequency filter being connected between the unshielded section and the E-field antenna.

17. The method in accordance with claim 16, wherein the second input frequency filter and the second output frequency filter are high pass or band pass filters.

18. The method in accordance with claim 16, further comprising radiating through the E-field antenna the second radio frequency signal after passing through the second output frequency filter.

19. The method in accordance with claim 16, wherein the second input frequency filter and the second output frequency filter comprise passive components.

20. The method in accordance with claim 19, wherein the first output frequency filter is an inductor and the second output frequency filter is a capacitor.

* * * * *